United States Patent [19]

Gleason

[11] 4,020,782

[45] May 3, 1977

[54] CONVERTIBLE SURFBOARD

[76] Inventor: John Gleason, 125-10 Queens Blvd., Kew Gardens, N.Y. 11415

[22] Filed: Jan. 26, 1976

[21] Appl. No.: 652,536

[52] U.S. Cl. ..... 115/70; 9/310 E

[51] Int. Cl.[2] ..... A63H 5/08

[58] Field of Search ..... 9/310 B, 310 E; 114/16 A, 16 G; 115/6.1, 18 A, 18 E, 41 R, 70

[56] References Cited

UNITED STATES PATENTS

| | | | |
|---|---|---|---|
| 2,434,700 | 1/1948 | Keckley | 115/70 |
| 2,470,137 | 5/1949 | Brown | 115/70 |
| 2,901,757 | 9/1959 | Remington | 115/70 |
| 3,262,413 | 7/1966 | Douglas et al. | 115/70 |
| 3,342,156 | 9/1967 | Rayner et al. | 115/41 R |
| 3,408,976 | 11/1968 | Ellis | 115/70 |
| 3,548,778 | 12/1970 | Von Smagala-Romanoff | 115/70 |

*Primary Examiner*—Trygve M. Blix
*Assistant Examiner*—Jesus D. Sotelo
*Attorney, Agent, or Firm*—Joel Halpern

[57] ABSTRACT

A surfboard which is convertible from unpowered to motorized condition by the selective movement of a motor mounted in the elongated buoyant float member. Movement of the motor along the longitudinal axis of the float member does not substantially alter the floatation characteristics of the surfboard. Hand grip elements and a windshield are detachably connectable to the float member for use by the surfboard rider in a prone position during motorized operation.

6 Claims, 5 Drawing Figures

CONVERTIBLE SURFBOARD

BACKGROUND OF THE INVENTION

The present invention relates to surfboards and more particularly to a surfboard which is convertible from manual to motorized condition.

The disadvantages of non-motorized surfboards are well known. Thus, although surfboard riding is a popular sport along coastal regions where the surfboard may be driven towards the shore by manipulation of the board along the crests of the waves it has no utility on lakes or even along coastal areas during periods when there is no wave promulgation.

The use of motorized surfboards has been known heretofore. However, the construction of such surfboards, in order to accommodate the motors, has often been complex and expensive and frequently has required such structural modification of the surfboard as to adversely affect the flotation characteristics of the board when in use without the motor. U.S. Pat. No. 3,405,677 issued Oct. 15, 1968 to R. C. Smith, for example, required a downwardly projecting hollow fin for the housing of the motor.

SUMMARY OF THE INVENTION

It is one object of the invention to provide a surfboard which can readily be converted from unpowered to motorized condition without adversely affecting the flotation characteristics of the surfboard.

It is another object of the invention to provide a surfboard of simple and relatively inexpensive construction which can be readily converted from unpowered to motorized condition.

Other objects and advantages of the invention will become readily apparent from the following description of the invention.

According to the present invention there is provided a surfboard selectively convertible from unpowered to motorized form comprising:

- an elongated buoyant float member having motor supporting means for shiftably supporting a motor along the longitudinal center line thereof between operative and non-operative positions;
- a motor movably mounted in said float member;
- an electric storage battery mounted in said float member;
- and electrical connecting and control means operatively connecting said battery and motor.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
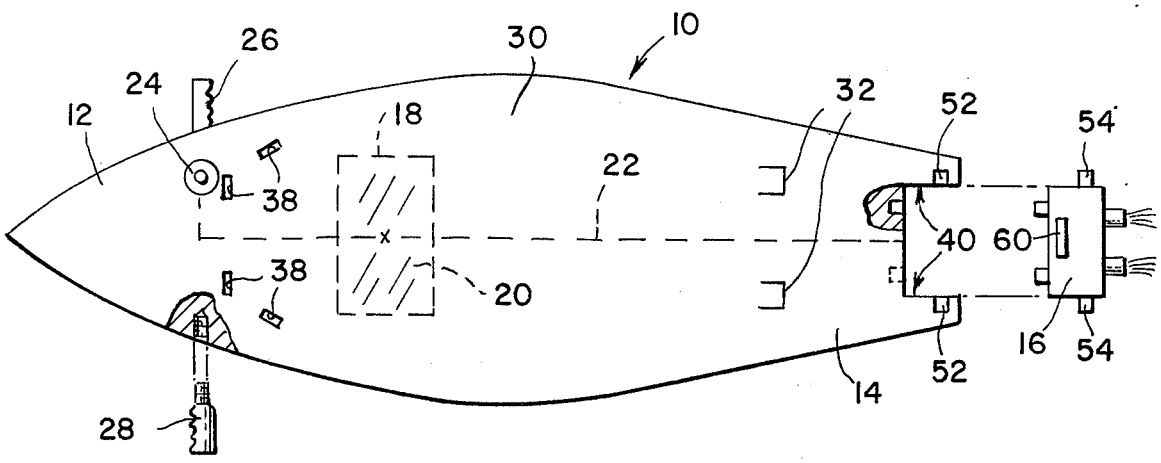
FIG. 1 is a top plan view of a surfboard embodying the features of the invention.

Referring to the drawings there is shown generally a surfboard 10. The board is an elongated buoyant member having a fore extremity 12 and an aft extremity 14. The board may be made of any convenient material so as to be either solid or hollow and to provide the desired flotation characteristics as is well known for surfing operation. The board may be made of polyurethane or an equivalent foam material with a molded fiberglass outer shell or of any of the conventional materials used in surfboard construction.

The surfboard is provided with a motor 16 in the aft section thereof which is movable along the longitudinal center line of the board between operative and inoperative positions as will be described herein.

A storage compartment 18 is formed in the float member along the longitudinal center line thereof and intermediate the fore and aft extremities of the board. An electric storage battery 20 is positioned within the storage compartment and is operatively connected with motor 16 by means of electrical conductors 22 an control means 24 which may conveniently be an on-off button switch or the like for activating the starter of the motor. The motor may either be an electric motor or an internal combustion engine depending upon the operating characteristics desired.

Figure 2:
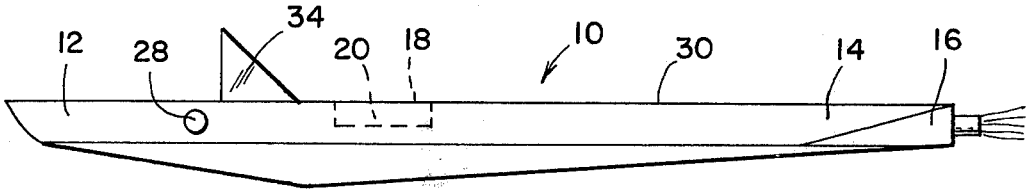
FIG. 2 is a side elevational view of the surfboard shown in FIG. 1 with a windshield in place.

As can be seen most clearly from FIGS. 1 and 2, hand grip elements 26, 28 are provided for detachable connection with the opposed sides of the fore section of the float member. A convenient means of securing the hand grip elements is to provide cooperable threads on the hand grip elements and in the side walls of the float member. The hand grip elements are employed by the surfboard rider when the motor is in operation to assist in steering the surfboard. At such times the rider lies in a prone position upon the deck 30 of the board with his feet in foot elements 32 formed on opposite sides of the longitudinal center line towards the aft section of the board. At such times the rider uses body "English" to control the steering of the board. In such prone position the motor control 24 is within easy reach for operatively controlling the motor. Although not shown it will be understood that speed control means can be incorporated with control means 24. If an internal combustion engine is employed then appropriate linkage can be provided to connect the control means 24 with throttle thereof. In the event that an electric motor is employed any of the usual speed regulators can be provided.

Figure 3:
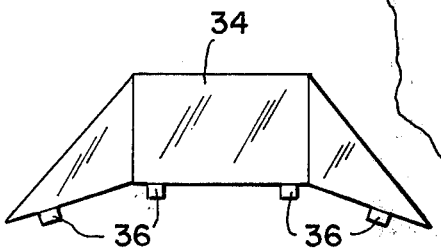
FIG. 3 is a perspective view of a windshield utilizable with the surfboard of the invention.

A windshield member 34 is connectable to the float member for use during periods of motorized operation. As shown in FIGS. 1, 2 and 3, the windshield may be provided with depending lugs or tongues 36 which are insertable within slots 38 formed in the deck of the float member. The tongues may be deformed to lock the windshield in place.

Figure 4A:
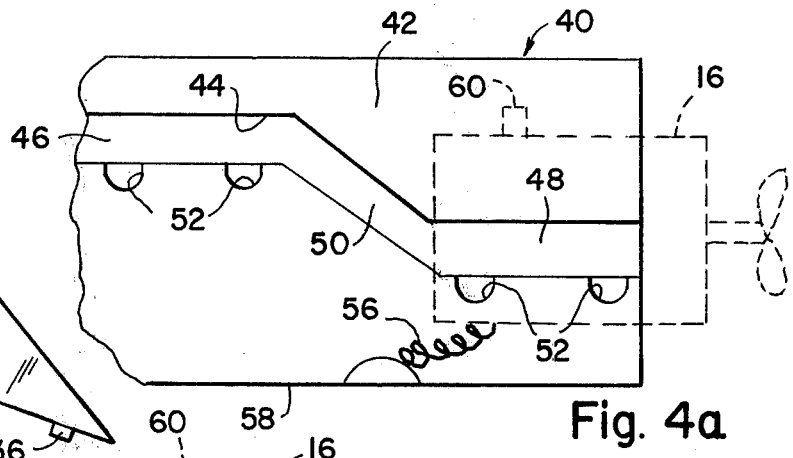
FIG. 4*a* and *b* are side elevational views, partly in cross-section, showing the motor mounting means with the motor in its operative and inoperative positions respectively.
Figure 4B:
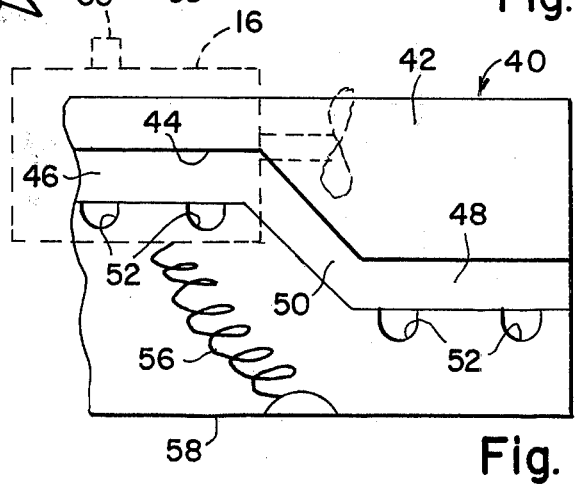

From FIGS. 1, 2 and 4 it will be seen that the motor 16 is preferably mounted in the aft section of the float member. A presently preferred construction for mounting of the motor includes a recess 40 formed in the float member straddling the longitudinal center line thereof to present inner opposed side walls 42, one of which is shown in FIGS. 4*a* and 4*b*. A cam track 44 is carried by each of the side walls 42 and is seen as including generally horizontal sections 46, 48 and an inclined section 50 connecting such horizontal sections. Each such horizontal section is provided with at least one detent-receiving recess 52 which is of such dimensions as to receive a detent lug 54 carried by the motor on the opposed sides thereof. The cam tracks thus provide an upper storage position for the motor and a lower operative position. FIG. 4*a* illustrates the motor shifted to its operative position whereas FIG. 4*b* illustrates the motor in its inoperative position. Spring means 56 are desirably articulately connected to a bottom wall 58 of the recess and are connected at the upper end to the lower portion of the motor. Thus, the spring 56, of which there may be more than one if so desired, applies a biasing force to the motor tending to seat the detent lugs within the detent-receiving recesses 52 of the cam track to insure retention of the motor in either the operative or non-operative position along the cam track as selected. A handle 60 may be provided on the motor to facilitate movement of the motor from one position to the other. It will be appreciated that the motor is shiftable from one position to the other along the longitudinal center line of the float member so as to minimize any effect upon the flotation characteristics thereof. The motor, in its non-operative position, will be moved closer to the center of gravity of the board and thereby effects only a minimal change in the flotation characteristics of the board. When the rider lies stomach down on the board during motorized operation the weight of the rider to a large extent compensates for the rearward shifting of the motor to its operative position to again minimize the flotation characteristics of the board.

From the foregoing it will be seen that a surfboard has been provided which is simple in construction and can easily be converted to motorized form by simply shifting the motor to an operative position, such conversion and the overall construction of the surfboard being of a character as to avoid any adverse effect upon the flotation characteristics of the board.

I claim:

1. A surfboard selectively convertible from an unpowered mode to a motorized mode comprising:

an elongated buoyant float member having fore and aft sections, said aft section including a recessed area therein having a pair of opposed inner side walls located respectively and equidistantly on opposite sides of the longitudinal center line of said float member;

a cam track in each of of said inner side walls extending longitudinally of said float member and adapted to shiftably support a motor for movement therealong between an upper operative position and a lower operative position, each said cam track having at least one detent-receiving recess in the portions thereof defining said operative and non-operative positions dimensioned to releasably retain a detent lug carried by the motor;

a motor shiftable mounted in said aft section of the float member having detent lugs thereon cooperable with said cam tracks and dimensioned to be removably positioned within the corresponding recesses in said cam tracks to thereby selectively locate said motor in one of said positions;

spring means positioned within said recessed area of the said aft section operatively connected to said motor and thereby adapted to urge said motor into locking relationship with said cam tracks;

an electric storage battery mounted in said float member; and electrical connecting and control means operatively connecting said battery and motor.

2. A convertible surfboard according to claim 1, including a storage compartment within said float member along the longitudinal center line thereof intermediate the fore and aft extremities of said float member, said battery being positioned within said compartment.

3. A convertible surfboard according to claim 1, including hand grip elements detachably connected to the opposed sides of said float member.

4. A convertible surfboard according to claim 1, including a windshield member detachably connected to the fore deck of said float member.

5. A convertible surfboard according to claim 1, wherein said motor means comprises an internal combustion engine and said motor mounting means are located within a recessed portion of the aft section of said float member.

6. A convertible surfboard according to claim 1, wherein a pair of foot engageable elements are provided in the aft section of said float member at opposite sides of the longitudinal center line thereof adapted to receive the feet of the surfboard rider when reposing in a prone position thereon.

* * * * *